US010428491B2

(12) United States Patent
Joung et al.

(10) Patent No.: US 10,428,491 B2
(45) Date of Patent: Oct. 1, 2019

(54) FLOW RATE CONTROL APPARATUS OF CONSTRUCTION EQUIPMENT AND CONTROL METHOD THEREFOR

(71) Applicants: VOLVO CONSTRUCTION EQUIPMENT AB, Eskilstuna (SE); Hea-Gyoon Joung, Busan (KR)

(72) Inventors: Hea-Gyoon Joung, Busan (KR); Jin-Young Tak, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 30 days.

(21) Appl. No.: 15/565,701

(22) PCT Filed: Apr. 29, 2015

(86) PCT No.: PCT/KR2015/004317

§ 371 (c)(1),
(2) Date: Oct. 11, 2017

(87) PCT Pub. No.: WO2016/175352

PCT Pub. Date: Mar. 11, 2016

(65) Prior Publication Data

US 2018/0073217 A1 Mar. 15, 2018

(51) Int. Cl.
*F15B 11/17* (2006.01)
*E02F 3/96* (2006.01)
(Continued)

(52) U.S. Cl.
CPC ..... *E02F 3/962* (2013.01); *E02F 9/20* (2013.01); *E02F 9/22* (2013.01); *E02F 9/2228* (2013.01);
(Continued)

(58) Field of Classification Search
CPC ..... F15B 11/16; F15B 11/165; F15B 11/167; F15B 11/17; F15B 2211/3116; E02F 9/2239
(Continued)

(56) References Cited

U.S. PATENT DOCUMENTS 5,970,709 A * 10/1999 Tohji ..... E02F 9/2242 60/421
5,996,341 A 12/1999 Tohji
(Continued)

FOREIGN PATENT DOCUMENTS

EP 1605168 A1 12/2005
EP 1674735 A2 6/2006
(Continued)

OTHER PUBLICATIONS

European Official Action (dated Nov. 7, 2018) for corresponding European App. 15 890 793.1.
(Continued)

*Primary Examiner* — Michael Leslie
(74) *Attorney, Agent, or Firm* — Sage Patent Group

(57) ABSTRACT

A flow rate control apparatus for construction equipment includes: a boom cylinder driven by hydraulic fluid; a first control valve for controlling a hydraulic fluid flow supplied to the boom cylinder; an option actuator driven by hydraulic fluid; a second control valve for controlling a hydraulic fluid flow supplied to the option actuator; a boom cylinder manipulation lever and an option actuator manipulation lever; a confluence line selectively confluence the hydraulic fluid supplied to the boom cylinder with the hydraulic fluid of the option actuator; a center bypass switching valve provided at the furthest downstream side of a fluid supply path of the first hydraulic pump; a confluence switching valve selectively opening and closing the confluence line; a confluence selection valve applying a pilot pressure to the confluence switching valve; and a controller for controlling the confluence selection valve.

9 Claims, 4 Drawing Sheets

(51) Int. Cl.

| | |
|---|---|
| ***F15B 11/16*** | (2006.01) |
| ***E02F 9/20*** | (2006.01) |
| ***E02F 9/22*** | (2006.01) |
| *F15B 11/064* | (2006.01) |

(52) U.S. Cl.
CPC ..... *E02F 9/2282* (2013.01); *E02F 9/2285* (2013.01); *E02F 9/2292* (2013.01); *E02F 9/2296* (2013.01); *F15B 11/165* (2013.01); *F15B 11/167* (2013.01); *F15B 11/17* (2013.01); *F15B 11/064* (2013.01); *F15B 2211/20576* (2013.01); *F15B 2211/3116* (2013.01); *F15B 2211/45* (2013.01); *F15B 2211/6313* (2013.01); *F15B 2211/6316* (2013.01)

(58) Field of Classification Search
USPC ..... 60/421, 428, 429, 484, 486
See application file for complete search history.

(56) References Cited

U.S. PATENT DOCUMENTS

| | | | | |
|---|---|---|---|---|
| 6,708,490 | B2 * | 3/2004 | Toji | E02F 9/2239 60/421 |
| 7,178,333 | B2 * | 2/2007 | Oka | E02F 9/2239 60/421 |
| 7,520,130 | B2 * | 4/2009 | Tanaka | F15B 11/17 60/421 |
| 7,565,801 | B2 * | 7/2009 | Tozawa | E02F 9/2075 60/484 |
| 7,594,395 | B2 * | 9/2009 | Oka | F15B 11/17 60/421 |
| 7,992,384 | B2 * | 8/2011 | Itakura | E02F 9/2228 60/421 |
| 8,464,826 | B2 * | 6/2013 | Yamada | B62D 11/005 60/421 |
| 8,919,115 | B2 * | 12/2014 | Hagiwara | E02F 9/2239 60/422 |
| 10,047,494 | B2 * | 8/2018 | Goto | E02F 3/32 |
| 2009/0056324 | A1 | 3/2009 | Itakura et al. | |

FOREIGN PATENT DOCUMENTS

| | | | |
|---|---|---|---|
| EP | 2719902 | A1 | 4/2014 |
| KR | 100657035 | B1 | 12/2006 |
| KR | 1020080016589 | A1 | 2/2008 |
| KR | 1020110093660 | A1 | 8/2011 |
| KR | 101155717 | B1 | 6/2012 |
| KR | 1020120086288 | A | 8/2012 |

OTHER PUBLICATIONS

International Search Report (dated Dec. 1, 2015) for corresponding International App. PCT/KR/2015/004317.

* cited by examiner

[FIG. 1]
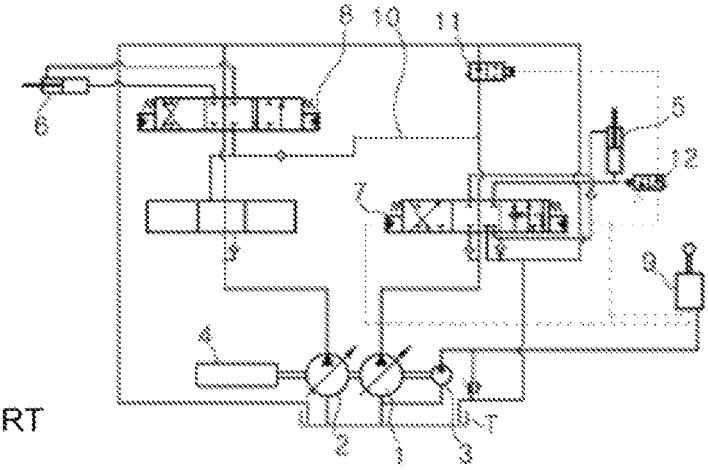
PRIOR ART
[FIG. 2]
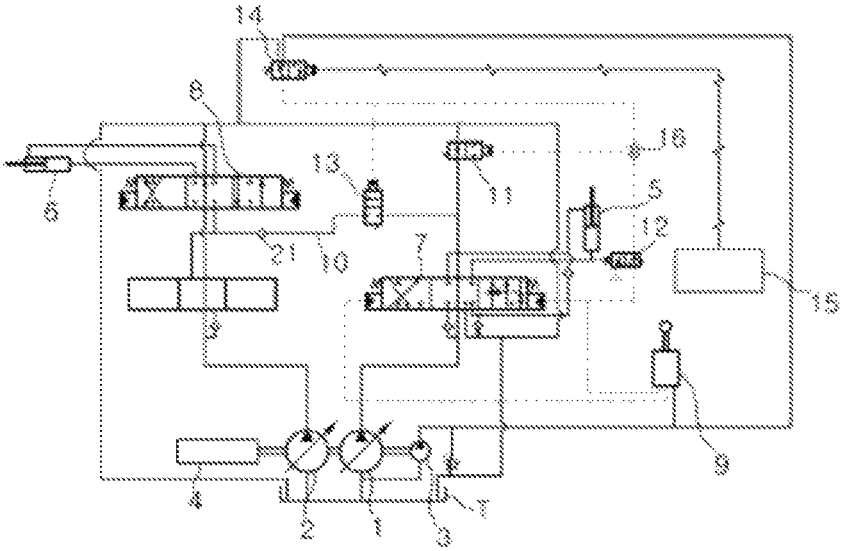

[FIG. 3]
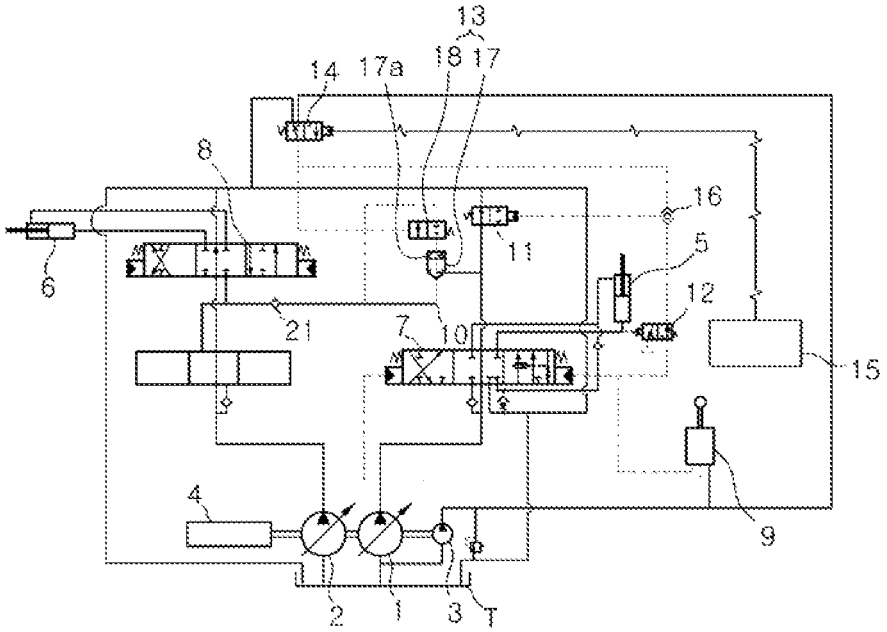
[FIG. 4]
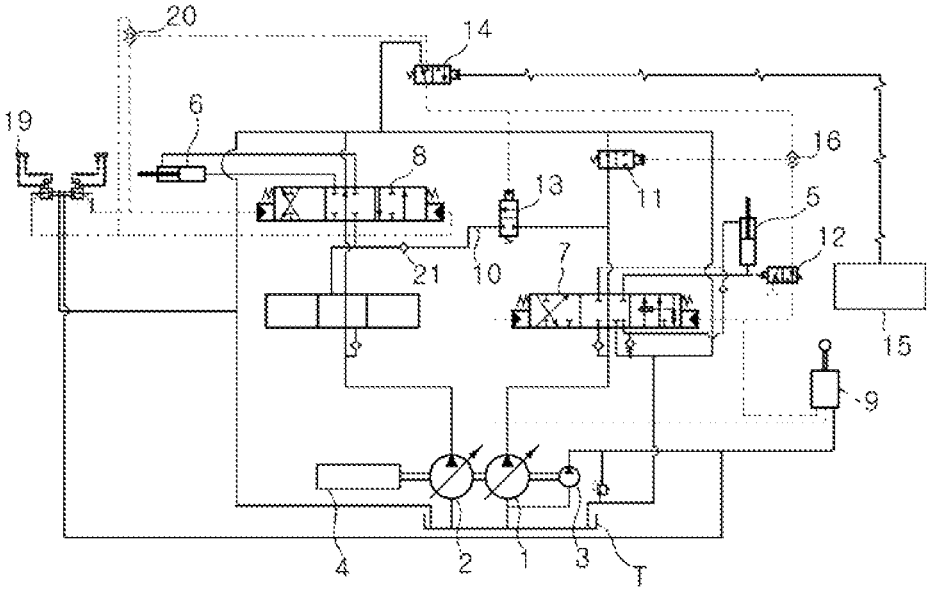

[FIG. 5]
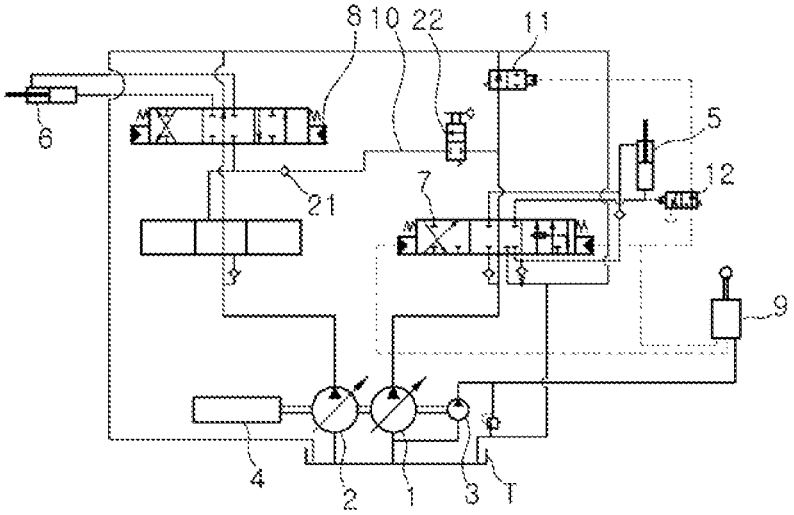

[FIG. 6]
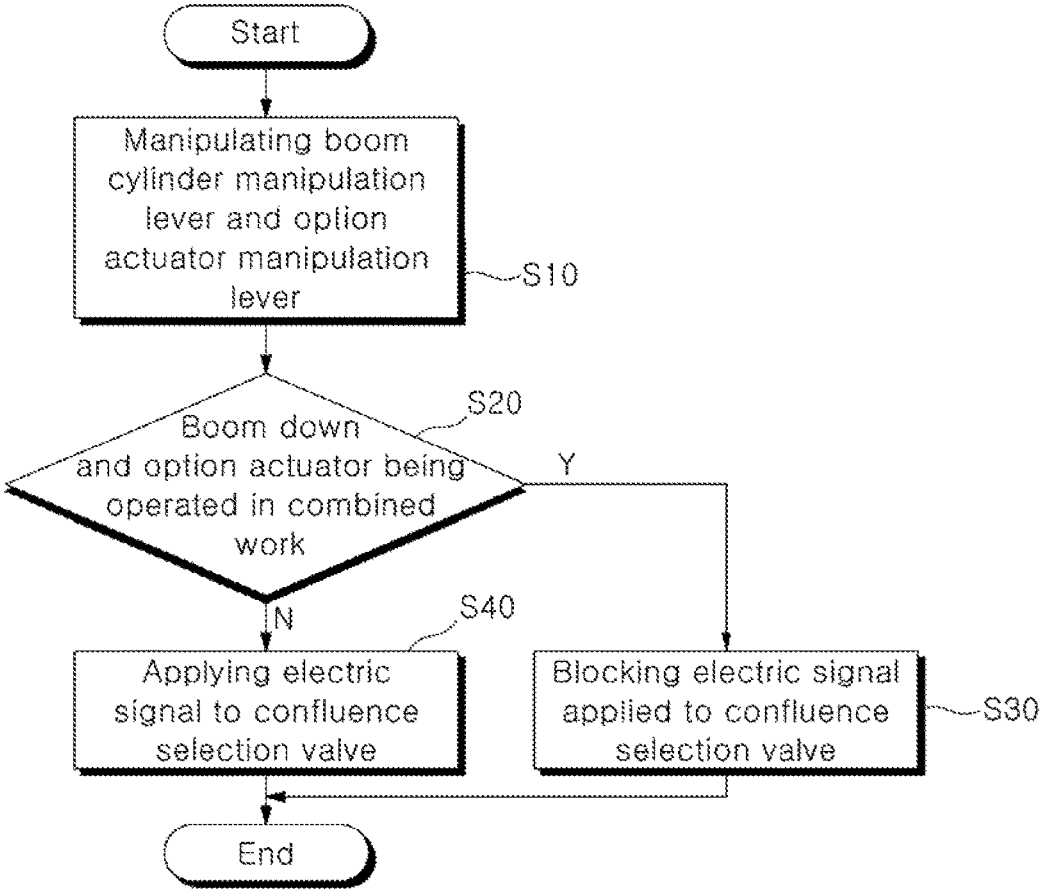

FLOW RATE CONTROL APPARATUS OF CONSTRUCTION EQUIPMENT AND CONTROL METHOD THEREFOR

BACKGROUND AND SUMMARY

The present invention relates to a flow rate control apparatus. More particularly, the present invention relates to a flow rate control apparatus for construction equipment for controlling a flow of hydraulic fluid supplied from a hydraulic pump to a work implement and an option actuator, and a control method therefor.

FIG. 1 is a hydraulic circuit diagram of a conventional flow rate control apparatus for construction equipment.

As shown in FIG. 1, first and second variable displacement hydraulic pumps 1 and 2 (hereinafter, referred as "first and second hydraulic pumps") and a pilot pump 3 is connected to an engine 4.

A boom cylinder 5 driven by hydraulic fluid of the first hydraulic pump 1 is connected to the first hydraulic pump 1.

An option actuator 6 driven by hydraulic fluid of the second hydraulic pump 2 is connected to the second hydraulic pump 2.

A first control valve 7 (main control valve (MCV)) is provided in a fluid path between the first hydraulic pump 1 and the boom cylinder 5, and the first control valve controls a flow of the hydraulic fluid supplied from the first hydraulic pump 1 to the boom cylinder 5.

A second control valve 8 (MCV) is provided in a fluid path, between the second hydraulic pump 2 and the option actuator 6, and the second control valve controls a flow of the hydraulic fluid supplied from the second hydraulic pump 2 to the option actuator 6.

A boom cylinder manipulation lever 9 (remote control valve (RCV)) for inputting a manipulation signal to control the first control valve 7 is provided in a fluid path between the pilot pump 3 and the first control valve 7.

An option actuator manipulation lever (not shown) (RCV) for inputting a manipulation signal to control the second control valve 8 is provided in a fluid path, between the pilot pump 3 and the second control valve 8.

A confluence line 10 is connected at an inlet port thereof to a downstream side of a supply path of the first hydraulic pomp 1 and connected at an outlet port thereof to a meter-in port of the second control valve 8, and the confluence line 10 selectively loins a part of a flow rate supplied from the first hydraulic pump 1 to the boom cylinder 5 with allow rate of the option actuator 6.

A center bypass switching valve 11 (CBP) is provided in the furthest downstream side of the supply path of the first hydraulic pump 1, and an opening port thereof becomes closed when the center bypass switching valve 11 is operated by a pilot pressure applied by a manipulation of the boom cylinder manipulation lever 9.

According to the configuration described above, when the boom cylinder manipulation lever 9 is manipulated to perform a boom down operation by a retraction operation of the boom cylinder 5, the hydraulic fluid of the pilot pump 3 passes through the boom cylinder manipulation lever 9, and is applied to a right signal pressure port of the first control valve 7 as a pilot pressure.

In the figure, since a spool of the first control valve 7 is switched to a left direction, the hydraulic fluid of the first hydraulic pump 1 is supplied to a small chamber of the boom cylinder 5 by passing through the first control valve 7. Herein, the hydraulic fluid emitted from a large chamber of the boom cylinder 5 is returned to a hydraulic fluid tank T by passing through the first control valve 7.

Accordingly, the boom down operation is performed by the retraction operation of the boom cylinder 5.

Herein, a surplus flow rate, except for a flow rate required to perform the retraction operation of the boom cylinder 5 among the flow rate supplied from the first hydraulic pump 1, is returned to the hydraulic fluid tank T by passing through the center bypass switching valve 11.

As described above, when the retraction operation of the boom cylinder 5 is performed and a pressure generated in the large chamber of the boom cylinder 5 is equal to or less than a set pressure, a jack-up switching valve 12 maintains an initial state by elasticity of a valve spring thereof.

Accordingly, since the pilot pressure by the manipulation of the boom cylinder manipulation lever 9 is applied to an opposite side to a valve spring of the center bypass switching valve 11 by passing through the jack-up switching valve 12, the opening port of the center bypass switching valve 11 becomes closed.

Accordingly, the surplus flow rate of the flow rate supplied from the first hydraulic pump 1 to the small chamber of the boom cylinder 5 is supplied to the option actuator 6 by passing through the second control valve 8 along the confluence line 10.

As described above, when combined work is performed by driving the boom cylinder 5 to perform the boom down operation by the retraction operation of the boom cylinder 5, and by driving the option actuator 6 by the manipulation of the by the option actuator manipulation lever (not shown), the surplus flow rate of the flow rate supplied from the first hydraulic pump 1 to the small chamber of the boom cylinder 5 is supplied to the flow rate of the option actuator 6, thus fee performance of the option actuator 6 is interfered. In addition, when a jack up operation is performed by a retraction of the boom cylinder 5, the manipulability therefor is degraded by an insufficient flow rate supplied to the small chamber of the boom cylinder 5.

Accordingly, it is desirable to provide a flow rate control apparatus for construction equipment, wherein the flow rate control apparatus blocks a surplus flow rate of a boom down operation which being supplied to an option actuator when combined work of the boom down operation and an option actuator is performed, and a control method therefor.

According to an aspect of the present disclosure, there is provided a flow rate control apparatus for construction equipment, including:

first and second variable displacement hydraulic pumps and a pilot pump;

a boom cylinder driven by a hydraulic fluid of the first hydraulic pump;

a first control valve controlling a flow of the hydraulic fluid supplied from the first hydraulic pump to the boom cylinder;

an option actuator driven by a hydraulic fluid of the second hydraulic pump;

a second control valve controlling a flow of the hydraulic fluid supplied from the second hydraulic pump to the option actuator;

a boom cylinder manipulation lever for inputting a manipulation signal to control the first control valve, and an option actuator manipulation lever for inputting a manipulation signal to control the second control valve;

a confluence line connected at an inlet port thereof to a downstream side of a supply path of the first hydraulic pump, and connected at an outlet port thereof to a meter-in port of the second control valve;

a center bypass switching valve provided in the furthest downstream side of the supply path of the first hydraulic pump, and operated to close an opening port thereof by a pilot pressure applied thereto;

a confluence switching valve provided in the confluence line, and joining a part of the hydraulic fluid supplied from the first hydraulic pump to the boom cylinder with the hydraulic fluid of the option actuator when the confluence switching valve is operated to open an opening port thereof;

a confluence selection valve provided in a fluid path between the pilot pump and the confluence switching valve, and applying the pilot pressure to the confluence switching valve when the confluence switching valve is operated; and a controller controlling the confluence selection valve to block the pilot pressure supplied from the pilot pump to the confluence switching valve so that the confluence line becomes closed when combined work of the boom cylinder and the option actuator is performed.

According to another aspect of the present disclosure, there is provided a flow rate control apparatus for construction equipment, the apparatus including:

first and second variable displacement hydraulic pumps and a pilot pump;

a boom cylinder driven by a hydraulic fluid of the first hydraulic pump;

a first control valve controlling a flow of the hydraulic fluid supplied from the first hydraulic pump to the boom cylinder;

an option actuator driven by a hydraulic fluid of the second hydraulic pump;

a second control valve controlling a flow of the hydraulic fluid supplied from the second hydraulic pump to the option actuator;

a boom cylinder manipulation lever for inputting a manipulation signal to operate the first control valve, and an option actuator manipulation lever for inputting a manipulation signal to operate the second control valve;

a confluence line connected at an inlet port thereof to a downstream side a supply path of the first hydraulic pump, and connected at an outlet port thereof to a meter-in port of the second control valve;

a center bypass switching valve provided in the furthest downstream side of the supply path of the first hydraulic pump, and operated by a pilot pressure applied thereto so that an opening port thereof becomes closed; and a confluence switching valve provided in the confluence line, and manually operated to open or close the confluence line, According to another aspect of the present disclosure, there is provided a flow rate control method of construction equipment, wherein the construction equipment includes;

first and second variable displacement hydraulic pumps and a pilot pump;

a boom cylinder and an option actuator respectively connected to the first and second hydraulic pumps;

first and second control valves respectively controlling flows of a hydraulic fluid supplied to the boom cylinder and the option actuator;

a boom cylinder manipulation lever and an option actuator manipulation lever;

a confluence line selectively supplying the hydraulic fluid of the first hydraulic pump to the hydraulic fluid of the second hydraulic pump;

a confluence switching valve opening and closing the confluence line;

a confluence selection valve provided in a fluid path between the pilot pump and the confluence switching valve;

first and second pressure sensors respectively detecting pilot pressures applied to the first and second control valves by manipulations of the boom cylinder manipulation lever and the option actuator manipulation lever; and a controller connected to the first and second pressure sensors and the confluence selection valve, the method comprising;

receiving manipulation signals from the boom cylinder manipulation lever and the option actuator manipulation lever for driving the boom cylinder and the option actuator;

determining whether or not combined work of the boom cylinder and the option actuator is performed by using signals indicative of detection results of the first and second pressure sensors; and blocking a pilot pressure applied to the confluence switching valve so that the confluence line becomes closed when the combined work of the boom cylinder and the option actuator is performed.

According to the present invention including the above configuration, there is an effect on preventing performance interference of an option actuator caused by a surplus flow rate supplied from a boom down operation when a combined work of the boom down operation and an option actuator is performed, or preventing degradation of the manipulability due to an insufficient flow rate supplied to the boom cylinder.

DESCRIPTION OF DRAWINGS

FIG. 1 is a hydraulic circuit diagram of a conventional flow rate control apparatus for construction equipment.

FIG. 2 is a hydraulic circuit diagram of a flow rate control apparatus for construction equipment of an embodiment of the present invention.

FIG. 3 is a hydraulic circuit diagram of a flow rate control apparatus for construction equipment of another embodiment of the present invention.

FIG. 4 is a hydraulic circuit diagram of a flow rate control apparatus for construction equipment of still another embodiment of the present invention.

FIG. 5 is a hydraulic circuit diagram of a flow rate control apparatus for construction equipment of still another embodiment of the present invention.

FIG. 6 is a flowchart showing a flow rate control method of construction equipment of an embodiment of the present invention.

DESCRIPTION OF THE REFERENCE NUMERALS IN THE DRAWINGS

1; first hydraulic pump
3; pilot pump
5; boom cylinder
7; first control valve
9; boom cylinder manipulation lever (RCV)
11; center bypass switching valve
13; confluence switching valve
15; controller
17; logic valve
19; proportional control valve
21; check valve

DETAILED DESCRIPTION

Hereinafter, a flow rate control apparatus for construction, equipment and a control method therefor according to a preferred embodiment of the present, invention will be described in detail with reference to the accompanying drawings.

FIG. 2 is a hydraulic circuit diagram of a flow rate control apparatus for construction equipment of an embodiment of the present invention, FIG. 3 is a hydraulic circuit diagram of a flow rate control apparatus for construction equipment of another embodiment of the present invention, FIG. 4 is a hydraulic circuit diagram of a flow rate control apparatus for construction equipment of still another embodiment of the present invention, FIG. 5 is a hydraulic circuit diagram of a flow rate control apparatus for construction equipment of still another embodiment of the present invention, and FIG. 6 is a flowchart showing a flow rate control method of construction equipment of an embodiment of the present invention.

Referring to FIG. 2, in the flow rate control apparatus for construction equipment according to the embodiment of the present invention.

first and second variable displacement hydraulic pumps 1 and 2 (hereinafter, referred as "first and second hydraulic pumps") and a pilot pump 3 are connected to an engine 4.

A boom cylinder 5 driven by hydraulic fluid of the first hydraulic pump 1 is connected to the first hydraulic pump 1.

An option actuator 6 driven by-hydraulic fluid of the second hydraulic pump 2 is connected to the second hydraulic pump 2.

A first control valve 7 (MCV) is provided in a fluid path between the first hydraulic pump 1 and the boom cylinder 5, and controls a flow of the hydraulic fluid supplied from the first hydraulic pump 1 to the boom cylinder 5.

A second control valve 8 (MCV) is provided in a fluid path between the second hydraulic pump 2 and the option actuator 6S and controls a flow of the hydraulic fluid supplied from the second hydraulic pump 2 to the option actuator 6.

A boom cylinder manipulation lever 9 (RCV) for inputting a manipulation signal to control the first control valve 7 is provided in a fluid path between the pilot pump 3 and the first control valve 7.

An option actuator manipulation lever (not shown) (RCV) for inputting a manipulation signal to control the second control valve 8 is provided in a fluid path between the pilot pomp 3 and the second control valve 8.

A confluence line 10 is connected at an inlet port thereof to a downstream side of a supply path of the first hydraulic pump 1, and connected at an outlet port thereof to a meter-in port of the second control valve 8, and the confluence line 10 selectively joins a part of a flow rate supplied from the first hydraulic pump 1 to the boom cylinder 5 with a flow rate of the option actuator 6.

A center bypass switching valve 11 (center bypass valve (CBP)) is provided in the furthest downstream side of the supply path of the first hydraulic pump 1, an opening port of the center bypass switching valve 11. becomes closed when the center bypass switching valve 11 is operated by a pilot pressure that is applied by a manipulation of the boom cylinder manipulation lever 9.

A confluence switching valve 13 is provided in the confluence line 10, and joins a part of the hydraulic fluid supplied from the first hydraulic pump 1 to the boom cylinder 5 with the hydraulic fluid supplied from the second hydraulic pump 2 to the option actuator 6 when the confluence switching valve 13 is operated to open an opening port thereof.

A confluence selection valve 14 is provided in a fluid path between the pilot pump 3 and the confluence switching valve 13, and the confluence selection valve 14 applies the pilot pressure to the confluence switching valve 13 when the center bypass switching valve 11 is operated by an applied electric signal.

A controller 15 is connected to the confluence selection valve 14, and blocks the pilot pressure supplied from the pilot pump 3 to the confluence switching valve 13 by operating the confluence selection valve 14 so that the confluence line 10 becomes closed when combined work of the boom cylinder 5 and the option actuator 6 is performed, in addition, the controller 15 outputs an electric signal to the confluence selection valve 14 supplying the pilot pressure from the pilot pump 3 to the confluence switching valve 13 so that the confluence line 10 becomes open when the boom cylinder 5 or the option actuator 6 is independently driven.

In order to join the part of the hydraulic fluid supplied from the first hydraulic pump 1 to the boom cylinder 5, with the hydraulic fluid of the option actuator 6, a first shuttle valve 16 is connected at inlet ports thereof to the boom cylinder manipulation lever 9 and the confluence selection valve 14, and connected at an outlet port thereof to the center bypass switching valve 11. The first shuttle valve 16 controls the center bypass, switching valve 11 by applying thereto a selected pilot pressure among the pilot pressures from the boom cylinder manipulation lever 9 and the pilot pressure from the confluence selection valve 14.

As shown in FIG. 3, the confluence switching valve 13 may include;

a logic valve 17 provided in the confluence line 10; and a switching valve 18 provided in a fluid path between a back pressure chamber 17*a* of the logic valve 17 and the confluence selection valve 14, and switches a poppet of the logic valve 17 to open the logic valve by draining hydraulic fluid of the back pressure chamber 17*a* so that the confluence line 10 is open when the switching valve is operated by the pilot pressure applied from the confluence selection valve 14.

Accordingly; when combined work by the boom down operation and driving the option actuator 6 is performed, since the electric signal applied to the confluence selection valve 14 is blocked by the controller 15, a pilot line supplying the hydraulic fluid of the pilot pump 3 to the switching valve 18 connected to the back pressure chamber 17*a* of the logic valve 17 is connected to a tank line.

Accordingly, the confluence line 10 maintains an initial state that is a closed state by the poppet of the logic valve 17.

Meanwhile, when the boom down, operation, or the driving of the option actuator 6 is independently performed, the confluence selection valve 14 is becomes an ON state by the electric signal output from the controller 15. Accordingly, the hydraulic fluid of the pilot pump 3 is applied as the pilot pressure to an opposite side to a valve spring of the switching valve 18 by passing through the confluence selection valve 14, and the switching valve 18 becomes an OM state. The confluence line 10 is open since the hydraulic fluid of the back pressure chamber 17*a* of the logic valve 17 is drained by the operation of the switching valve 18.

As shown in FIG. 4, a means for supplying the pilot pressure to the confluence selection valve 14 to operate the confluence switching valve 13 includes: a proportional control valve 19 that is provided in the fluid path between the pilot pump 3 and the second control valve 8, converts a manipulation pressure supplied from the pilot pump 3 into a second pressure associated with an electric signal output from the controller 15, and applies the converted second pressure to the second control valve 8; and a second shuttle valve 20 that is connected at inlet ports thereof to a fluid path between the proportional control valve 19 and the second control valve 8 and connected at an outlet port thereof to the confluence selection valve 14, and applies a selected pilot pressure among pilot pressures applied to left/ right pressure ports of the second control valve 8 to the confluence switching valve 13 by operating the confluence selection valve 14.

A check valve 21 is provided in the confluence line 10 to prevent a reverse of the hydraulic fluid when a load pressure generated in the option actuator 6 is higher than a load pressure generated in the boom cylinder 5.

A first pressure sensor (not shown) that detects the pilot pressure applied to the first control valve 7 by the manipulation of the boom cylinder manipulation lever 9 is connected to the controller 15, and a second pressure sensor (not shown) that detects the pilot pressure applied to the second control valve 8 by the manipulation of the option actuator manipulation lever (not shown) is connected to the controller 15.

According to the configuration described above, as described in step S10 of FIG. 6, when the boom cylinder manipulation lever 9 is manipulated to perform a boom, down operation by an retraction operation of the boom cylinder 5, a pilot pressure by the boom cylinder manipulation lever 9 is applied to a right signal pressure port of the first control valve 7, and a spool of the first control valve 7 is switched to a left direction in the figure.

Accordingly, the hydraulic fluid of the first hydraulic pump 1 is supplied to a small chamber of the boom cylinder 5 by passing through the first control valve 7, and the hydraulic fluid emitted from a large chamber of the boom cylinder 5 is returned to a hydraulic fluid tank T by passing through the first control valve 7. Accordingly, the boom down operation is performed by the retraction operation of the boom cylinder 5.

Herein, when a pressure generated in the large chamber of the boom cylinder 5 exceeds a set value, in order to switch a jack-up switching valve 12, the pilot pressure is applied to an opposite side to a valve spring of the jack-up switching valve 12.

Since the jack-up switching valve 12 becomes an ON state, a pilot line that supplies the pilot pressure to the center bypass switching valve 11 by the manipulation of the boom cylinder manipulation lever 9 is connected to a tank line. Accordingly, the center bypass switching valve 11 maintains an initial state in which the opening port thereof is open by elasticity of the valve spring of the center bypass switching valve 11.

Accordingly, a surplus flow rate, except for the flow rate supplied from the first hydraulic pump 1 to the small chamber for the retraction operation of the boom cylinder 5, is drained to the hydraulic, fluid tank T by passing through the center bypass switching valve 11.

Meanwhile, the pilot pressure applied to the first control valve 7 by the manipulation of the boom cylinder manipulation lever 9 is detected by the first, pressure sensor (not shown), and transmitted to the controller 15.

Meanwhile, when the option, actuator manipulation lever (not shown) is manipulated to drive the option actuator 6, the pilot pressure by the option actuator manipulation lever 9 is applied to a signal pressure port of the second control valve 7, and a spool of the second control valve 7 is switched to a right direction in the figure.

Accordingly, the hydraulic fluid of the second hydraulic pump 2 is supplied to a large chamber or small chamber of the option actuator 6 by passing through the second control valve 8, thus the option actuator may be driven.

Herein, the pilot pressure applied to the second control valve 8 by the manipulation of the option actuator manipulation lever is detected by the second pressure sensor (not shown), and transmitted to the controller 15.

As described in step S20, the controller 15 determines whether or not combined work by performing the boom down operation by using the boom cylinder manipulation lever 9 and driving the option actuator 6 by using the option actuator manipulation lever is performed by using indicative signals of detection results input from the first and second pressure sensors.

When the combined work of the boom down operation and driving the option actuator 6 is performed, step "S30" is processed, when the boom down operation or the driving of the option actuator 6 is independently performed, step "S40" is processed.

As described in step S30, when the combined work of the boom down-operation and driving the option actuator 6 is performed, the confluence line 10 becomes closed.

In more detail, since the electric signal applied to the confluence selection valve 14 by the-controller 15 is blocked, the confluence .selection valve 14 is connected to the tank line by the elasticity of a valve spring of the confluence selection valve 14.

Accordingly, since the pilot line supplying the hydraulic fluid from the pilot pump 3 to the confluence switching valve 13 becomes closed, the confluence switching valve 13 maintains an initial state which blocks the confluence line 10 by elasticity of a valve spring of the confluence switching valve 13.

Accordingly, the hydraulic fluid of the first hydraulic pump 1 is supplied only to the small chamber of the boom cylinder 5, thus a smooth jack-up operation may be ensured by the retraction operation of the boom cylinder 5.

As described in step S40, when the boom down operation or the operation of the option actuator 6 is independently performed, the confluence line 10 is open.

In more detail, the continence selection valve 14 becomes an ON state since the electric signal is applied to an opposite side to the valve spring of the confluence selection valve 14 by the controller 15. Accordingly, the hydraulic fluid from the pilot pump 3 is applied as the pilot pressure to an opposite side to the salve spring of the confluence switching valve 13 by passing through the confluence selection valve 14.

Accordingly, the confluence switching valve 13 becomes an ON state, thus the confluence line 10 becomes open. Herein, the center bypass switching valve 11 becomes an ON state by the pilot pressure emitted from the first shuttle valve 16 connected to the confluence selection valve 14.

Accordingly, since the confluence line 10 is open, a part of the hydraulic fluid of the first hydraulic pump 1 is supplied to the small chamber of the boom cylinder 5, and the boom down operation is performed. At the same time, a part of the hydraulic fluid of the first hydraulic pump 1, excluding the flow rate required for the boom down operation, may be merged with the hydraulic fluid supplied from the second hydraulic pump 2 to the option actuator 6 by passing through the confluence line 10.

As described above, according to the flow rate control apparatus for construction equipment of the embodiment of the present invention, and the control method therefor, when the combined work of the boom down operation and the driving of the option actuator is performed, the boom down operation may be performed by closing the confluence line 10, and supplying the hydraulic fluid of the first hydraulic pump 1 only to the small chamber of the boom cylinder 5.

Meanwhile, when the boom down operation or the driving of the option actuator 6 is independently performed, the boom down operation may be performed by opening the confluence line 10, supplying the part of the hydraulic fluid of the first hydraulic pump 1 to the boom cylinder 5, and simultaneously confluence the part of the hydraulic fluid of the first hydraulic pump 1 with the hydraulic fluid supplied to the option actuator 6.

Referring to FIG. 5, in the flow rate control apparatus for construction equipment according to another embodiment of the present invention.

first and second variable displacement hydraulic pumps 1 and 2 (hereinafter, referred as "first and second hydraulic pumps") and a pilot pump 3 are connected to an engine 4.

A boom cylinder 5 that is driven by hydraulic fluid of the first hydraulic pump 1 is connected to the first hydraulic pump 1.

An option actuator 6 that is driven by hydraulic fluid of the second hydraulic pump is connected to the second hydraulic pump.

A first control salve 7 (MCV) is provided in a fluid path between the first hydraulic pump 1 and the boom cylinder 5, and controls a flow of the hydraulic fluid supplied from the first hydraulic pump 1 to the boom cylinder 5.

A second control valve 8 (MCV) is provided in a fluid path between the second hydraulic pump 2 and the option actuator 6, and controls a flow of the hydraulic fluid supplied from the second hydraulic pump 2 to the option actuator 6.

A boom cylinder manipulation lever 9 (RCV) for inputting a manipulation signal to control the first control valve 7 is provided in a fluid path between the pilot pump 3 and the first control valve 7.

An option actuator manipulation lever (not shown) (RCV) for inputting a manipulation signal to control the second control valve 8 is provided in a fluid path between the pilot pump 3 and the second control valve 8.

A confluence line 10 is connected at an inlet port thereof to a downstream side of a supply path of the first hydraulic pump 1 with and connected at an outlet port thereof to a meter-in port of the second control valve 8, and the confluence line 10 selectively joins a part of the flow rate supplied from the first hydraulic pump 1 to the boom cylinder 5 with the option actuator 6.

A center bypass switching valve 11 (center by pass valve (CBP)) is provided in the furthest downstream, side of the supply path of the first hydraulic pump 1, and the center bypass switching valve 11 is operated by a pilot pressure applied by the manipulation of the boom cylinder manipulation lever 9 so that an opening port thereof becomes closed.

An ON/OFF manual type continence switching valve 22 for opening and closing the confluence line 10 is provided in the confluence line 10. The manual type confluence switching valve 22 may open and close the confluence line 10 when a handle or a lever (not shown) is manipulated by an operator.

Herein, since the confluence line 10 is open and closed by the confluence switching valve 22, hydraulic circuit elements including the controller 15, the confluence selection valve(14), the first shuttle valve 16, electric wirings, pipes, etc which configure the flow rate control apparatus shown in FIG. 2 become unnecessary, so the hydraulic circuit configuration may be simplified.

While the present invention has been described with reference to the preferred embodiments, the present invention is not limited to the above-described embodiments, and it will be understood by those skilled in the related art that various modifications and variations may be made therein without departing from the scope of the present invention as defined by the appended claims.

INDUSTRIAL APPLICABILITY

According to the present invention including the above described configuration, there is an effect on improving a manipulability of a jack-up operation by increasing a flow rate supplied front a hydraulic pump to a boom-cylinder when performing the jack-up operation of an excavator.

The invention claimed is:

1. A flow rate control apparatus for construction equipment, the apparatus comprising:

first and, second variable displacement hydraulic pumps and a pilot pump;

a boom cylinder driven by a hydraulic fluid of the first hydraulic pump;

a first control valve controlling a flow of the hydraulic fluid supplied from the first hydraulic pump to the boom cylinder;

an option actuator driven by a hydraulic fluid of the second hydraulic pump;

a second control valve controlling a flow of the hydraulic fluid supplied from the second hydraulic pump to the option actuator;

a boom cylinder manipulation lever for inputting a manipulation signal to control the first control valve, and an option actuator manipulation lever for inputting a manipulation signal to control the second control valve;

a confluence line connected at an inlet port thereof to a downstream side of a supply path of the first hydraulic pump, and connected at an outlet port thereof to a meter-in port of the second control valve;

a center bypass switching valve provided in the furthest downstream side of the supply path of the first hydraulic pump, and operated to close an opening port thereof by a pilot pressure applied thereto;

a confluence switching valve provided in the confluence line, and joining a part of the hydraulic fluid supplied from the first hydraulic pump to the boom cylinder with the hydraulic fluid of the option actuator when the confluence switching valve is operated to open an opening port thereof;

a confluence selection valve provided in a fluid path between the pilot pump and the confluence switching valve, and applying the pilot pressure to the confluence switching valve when the confluence switching valve is operated; and a controller controlling the confluence selection valve to block the pilot pressure supplied from the pilot pump to the confluence switching valve so that the confluence line becomes closed when combined work of the boom cylinder and the option actuator is performed.

2. The apparatus of claim 1, wherein when the boom cylinder or the option actuator is independently driven, the controller applies an electric signal to the confluence selection valve so that the confluence switching valve is operated by the pilot pressure supplied from the pilot pump to open the confluence line.

3. The apparatus of claim 1, further comprising: a first shuttle valve connected at inlet ports thereof to the boom cylinder manipulation lever and the confluence selection valve and connected at an outlet port thereof to the center bypass switching valve, and operating the center bypass switching valve by applying thereto a selected pilot pressure among the pilot pressure from the boom cylinder manipulation lever and the pilot pressure from the confluence selection'valve so that a part of the hydraulic fluid supplied to the boom cylinder is joined to the hydraulic fluid of the option actuator.

4. The apparatus of claim 1, wherein the confluence switching valve includes:

a logic valve provided in the confluence line; and a switching valve provided in a fluid path between a back pressure chamber of the logic valve and the confluence selection valve, and operating the logic valve to open the logic valve by draining a hydraulic fluid of the back pressure chamber so that the confluence line becomes open when the switching valve is operated by the pilot pressure of the confluence selection valve.

5. The apparatus of claim 1, further comprising, as a means for supplying the pilot pressure to the confluence selection valve to operate the confluence switching valve, a proportional control valve provided in a fluid path between the pilot pump and the second control valve, and converting a manipulation pressure supplied from the pilot pump into a second, pressure corresponding to an electric signal output from the controller, and applying the converted second pressure to the second control valve; and a second shuttle valve connected to at an inlet port thereof to a fluid path between the proportional control valve and the second control valve, and connected at an outlet port thereof to the confluence selection valve so that a selected pilot pressure among pilot pressures applied to left and right pressure ports of the second control valve is applied to the confluence switching valve via operation of the confluence selection valve.

6. The apparatus of claim 1, further comprising: a check valve provided in the confluence line and preventing a reverse flow of the hydraulic fluid when a load pressure generated in the option actuator is higher than a load pressure generated in the boom cylinder.

7. The apparatus of claim 1, further comprising:

a first pressure sensor detecting the pilot pressure applied to the first control valve by a manipulation of the boom cylinder manipulation lever, and outputting a signal indicative of the detected pilot pressure to the controller; and a second pressure sensor detecting the pilot pressure applied to the second control valve by a manipulation of the option actuator manipulation lever, and outputting a signal indicative of the detected pilot pressure to the controller.

8. A flow rate control method of construction equipment, wherein the construction equipment comprising:

first and second variable displacement hydraulic pumps and a pilot pump;

a boom cylinder and an option actuator respectively connected to the first and second hydraulic pumps;

first and second control valves respectively controlling flows of a hydraulic fluid supplied to the boom cylinder and the option actuator;

a boom cylinder manipulation lever and an option actuator manipulation lever;

a confluence line selectively supplying the hydraulic fluid of the first hydraulic pump to the hydraulic fluid of the second hydraulic pump;

a confluence switching valve opening and closing the confluence line;

a confluence selection valve provided in a fluid path between the pilot pump and the confluence switching valve;

first and second pressure sensors respectively detecting pilot pressures applied to the first and second control valves by manipulations of the boom cylinder manipulation lever and the option actuator manipulation lever; and a controller connected to the first and second pressure sensors and the confluence selection valve, the method comprising:

receiving manipulation signals from the boom cylinder manipulation lever and the option actuator manipulation lever for driving the boom cylinder and the option actuator;

determining whether or not combined work of the boom cylinder and the option actuator is performed by using signals indicative of detection results of the first and second pressure sensors; and blocking a pilot pressure applied to the confluence switching valve so that the confluence line becomes closed when the combined work of the boom cylinder and the option actuator is performed.

9. The method of claim 8, further comprising: when the boom cylinder or the option actuator is independently driven, in order to open the confluence line, operating the confluence switching valve by applying the pilot pressure thereto.

* * * * *